US005984046A

United States Patent [19]

Urso, Jr.

[11] Patent Number: 5,984,046

[45] Date of Patent: Nov. 16, 1999

[54] DRILL HOLSTER

[76] Inventor: Edward R. Urso, Jr., 6047 N. Navarre, Chicago, Ill. 60631

[21] Appl. No.: 09/160,271

[22] Filed: Sep. 24, 1998

[51] Int. Cl.[6] ..... A45F 5/00

[52] U.S. Cl. ..... 182/129; 224/253; 224/904

[58] Field of Search ..... 182/129; 248/210; 224/904, 911

[56] References Cited

U.S. PATENT DOCUMENTS

| | | |
|---|---|---|
| 894,569 | 7/1908 | Batchelder . |
| 1,320,751 | 11/1919 | Freyer . |
| 2,109,232 | 2/1938 | Hoyt . |
| 4,917,281 | 4/1990 | Ostermiller . |
| 4,953,767 | 9/1990 | Bennett . |
| 5,269,448 | 12/1993 | Shoemaker . |

*Primary Examiner*—Alvin Chin-Shue

[57] ABSTRACT

A drill holster including a holder portion dimensioned for receiving a drill therein. The holder portion is defined by a front panel and a rear panel secured together along lower and side edges thereof leaving an open upper end to receive a drill therein. The holder portion includes a wide upper portion and a narrow lower portion. The wide upper portion accommodates a handle of the drill. The narrow lower portion has an opening through the secured lower edges of the front and rear panels to accommodate a drill bit of the drill therethrough. A pair of side straps are freely secured to the rear panel of the holder portion to facilitate securement to a ladder.

1 Claim, 3 Drawing Sheets

DRILL HOLSTER

BACKGROUND OF THE INVENTION

1. Field of the Invention

The present invention relates to a drill holster and more particularly pertains to attaching a drill to a ladder for easy access by a user with a drill holster.

2. Description of the Prior Art

The use of tool holding devices is known in the prior art. More specifically, tool holding devices heretofore devised and utilized for the purpose of containing tools therein are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,998,416; U.S. Pat. No. 4,515,242; U.S. Pat. No. 5,031,723; U.S. Pat. No. 5,052,581; U.S. Pat. No. 5,419,409; U.S. Pat. No. 5,437,502; U.S. Pat. No. 5,542,553; U.S. Pat. No. 5,603,405; and U.S. Pat. No. 5,622,278.

While these devices fulfill their respective, particular objective and requirements, the aforementioned patents do not describe a drill holster for attaching a drill to a ladder for easy access by a user.

In this respect, the drill holster according to the present invention substantially departs from the conventional concepts and designs of the prior art, and in doing so provides an apparatus primarily developed for the purpose of attaching a drill to a ladder for easy access by a user.

Therefore, it can be appreciated that there exists a continuing need for new and improved drill holster which can be used for attaching a drill to a ladder for easy access by a user. In this regard, the present invention substantially fulfills this need.

SUMMARY OF THE INVENTION

In the view of the foregoing disadvantages inherent in the known types of tool holding devices now present in the prior art, the present invention provides an improved drill holster. As such, the general purpose of the present invention, which will be described subsequently in greater detail, is to provide a new and improved drill holster and method which has all the advantages of the prior art and none of the disadvantages.

To attain this, the present invention essentially comprises a holder portion dimensioned for receiving a drill therein. The holder portion is defined by a front panel and a rear panel secured together along lower and side edges thereof leaving an open upper end to receive a drill therein. The holder portion includes a wide upper portion and a narrow lower portion. The wide upper portion accommodates a handle of the drill. The narrow lower portion has an opening through the secured lower edges of the front and rear panels to accommodate a drill bit of the drill therethrough. A plurality of pouches are secured to the front panel of the holder portion. A pair of side straps are freely secured to the rear panel of the holder portion to facilitate securement to a ladder. The side straps extend through angularly disposed slots disposed on the rear panel. A free end of each of the side straps have D-rings disposed thereon to allow for adjustable securement of the holder portion to the ladder. The uppermost side strap is positioned above and over the top rung of the smaller rear side of the ladder. This placement prevents the drill holster from slipping down the leg of the ladder. The lowermost side strap is positioned around the leg of the ladder. A top strap extends over the open upper end of the holder portion to secure the drill therein. The top strap has a pair of female snap fasteners disposed on a free end thereof for mating with a pair of male snap fasteners on the front panel of the holder portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drill holster which has all the advantages of the prior art tool holding devices and none of the disadvantages.

It is another object of the present invention to provide a new and improved drill holster which may be easily and efficiently manufactured and marketed.

It is a further object of the present invention to provide a new and improved drill holster which is of durable and reliable construction.

An even further object of the present invention is to provide a new and improved drill holster which is susceptible of a low cost of manufacture with regard to both materials and labor, and which accordingly is then susceptible of low prices of sale to the consuming public, thereby making such a drill holster economically available to the buying public.

Even still another object of the present invention is to provide a new and improved drill holster for attaching a drill to a ladder for easy access by a user.

Lastly, it is an object of the present invention to provide a new and improved drill holster including a holder portion dimensioned for receiving a drill therein. The holder portion is defined by a front panel and a rear panel secured together along lower and side edges thereof leaving an open upper end to receive a drill therein. The holder portion includes a wide upper portion and a narrow lower portion. The wide upper portion accommodates a handle of the drill. The narrow lower portion has an opening through the secured lower edges of the front and rear panels to accommodate a drill bit of the drill therethrough. A pair of side straps are freely secured to the rear panel of the holder portion to facilitate securement to a ladder. The uppermost side strap is positioned above and over the top rung of the smaller rear side of the ladder. This placement prevents the drill holster from slipping down the leg of the ladder. The lowermost side strap is positioned around the leg of the ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the drill holster constructed in accordance with the principles of the present invention.

FIG. 2 is a perspective view of the present invention illustrated in use.

FIG. 3 is a front elevation view of the present invention.

FIG. 4 is rear elevation view of the present invention.

The same reference numerals refer to the same parts through the various figures.

DESCRIPTION OF THE PREFERRED EMBODIMENT

Figure 1:
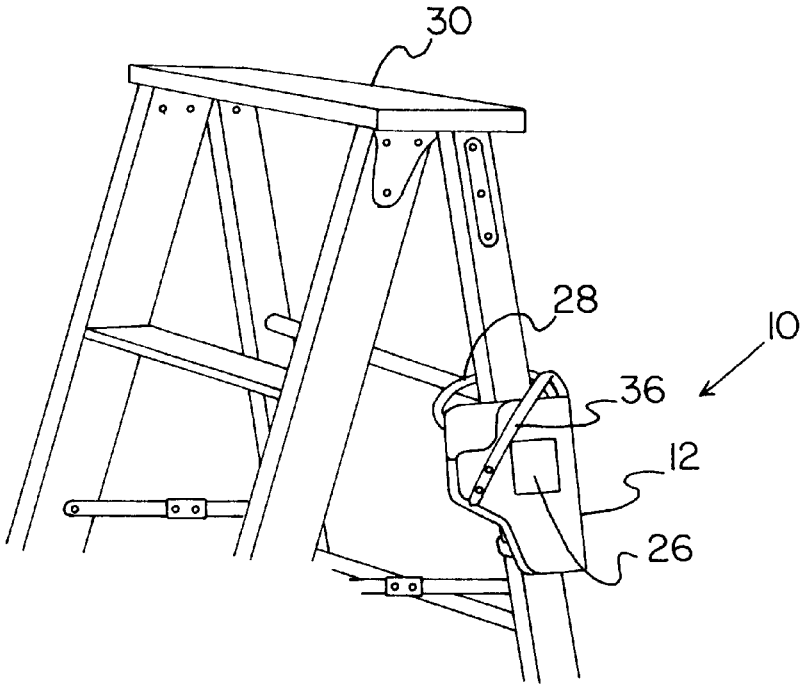
FIGS. 1 through 4 illustrate a right-hand version of the present invention.
Figure 2:
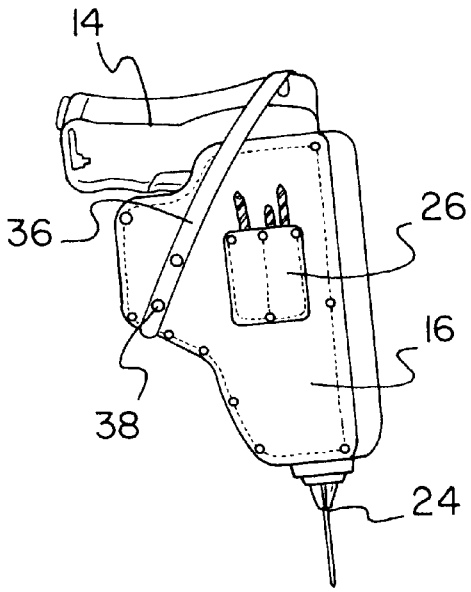
Figure 3:
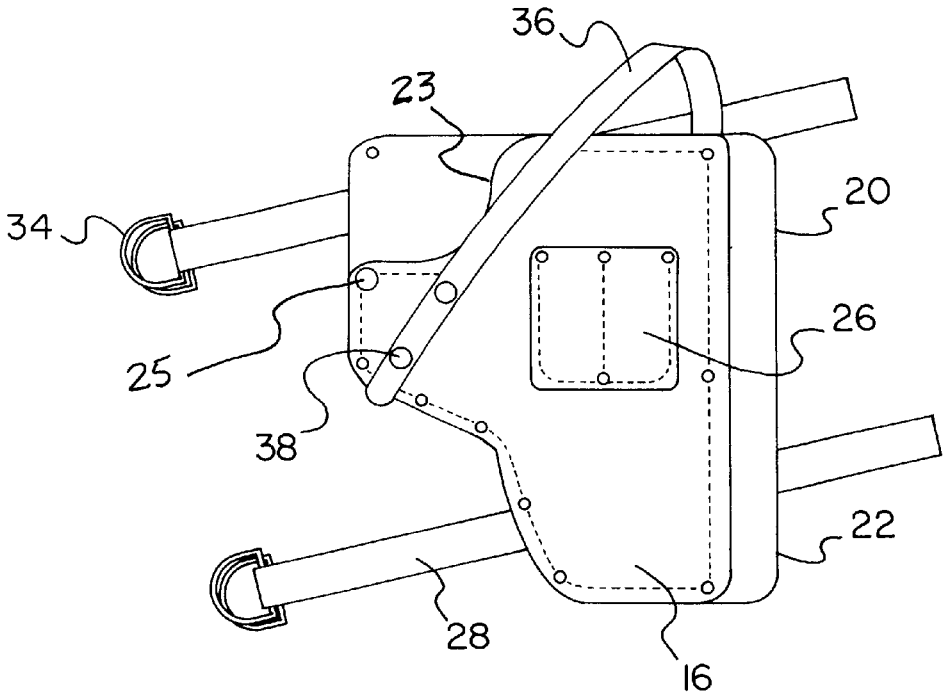
Figure 4:
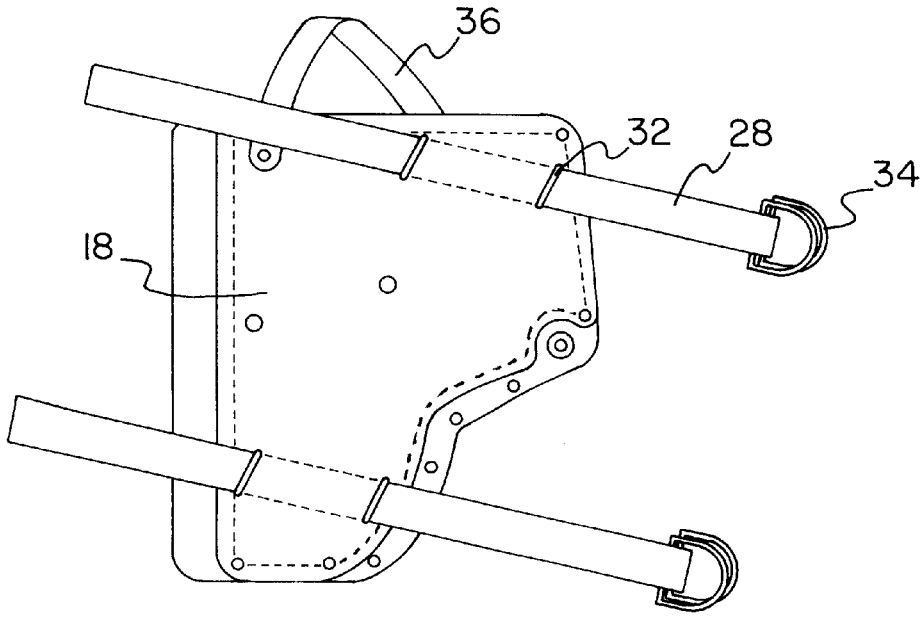
Figure 5:
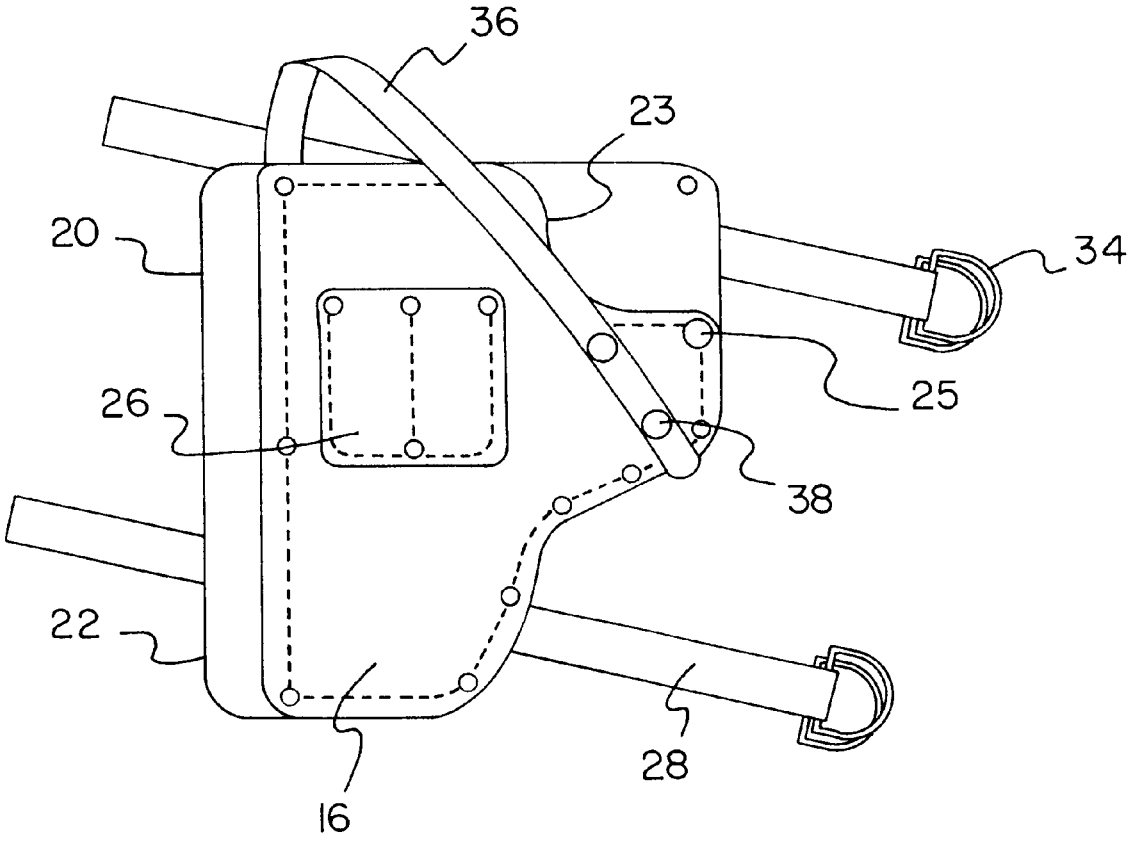
FIG. 5 is an alternate embodiment of the present invention, a front elevation view of a left hand version.

With reference now to the drawings, and in particular, to FIGS. 1 through 4 thereof, the preferred embodiment of the new and improved drill holster embodying the principles and concepts of the present invention and generally designated by the reference number 10 will be described.

Specifically, it will be noted in the various Figures that the device relates to a drill holster for attaching a drill to a ladder for easy access by a user. In its broadest context, the device consists of a holder portion, a plurality of pouches, a pair of side straps, and a top strap. Such components are individually configured and correlated with respect to each other so as to attain the desired objective.

The holder portion 12 is dimensioned for receiving a drill 14 therein. The holder portion 12 is defined by a front panel 16 and a rear panel 18 secured together along lower and side edges thereof leaving an open upper end to receive a drill therein. The rear panel 18 is comprised of at least one layer of material. An extra layer of material can be utilized in order prevent a drill body snagging or damaging other components of the device. The holder portion 12 includes a wide upper portion 20 and a narrow lower portion 22. The wide upper portion 20 accommodates a handle of the drill 14. The narrow lower portion 22 has an opening through the secured lower edges of the front and rear panels 16,18 to accommodate a drill bit 24 of the drill 14 therethrough. The wide upper portion 20 has a notch 23 formed within a corner thereof. The notch is included in the design of the present invention in order to prevent false triggering of the drill. The wide upper portion 20 has a closable snap fastener 25 disposed below the notch 23 for securing the front panel 16 to the rear panel 18. The snap fastener 25 also allows for the device to accommodate larger drills.

The plurality of pouches 26 are secured to the front panel 16 of the holder portion 12. The plurality of pouches 26 can be used to hold extra drill bits and other items associated with use of the drill 14.

The pair of side straps 28 are freely secured to the rear panel 18 of the holder portion 12 to facilitate securement to a ladder 30. The side straps 28 extend through angularly disposed slots 32 disposed on the rear panel 18. A free end of each of the side straps 28 have D-rings 34 disposed thereon to allow for adjustable securement of the holder portion 12 to the ladder 30. The uppermost side strap is positioned above and over the top rung of the smaller rear side of the ladder. This placement prevents the drill holster from slipping down the leg of the ladder. The lowermost side strap is positioned around one side leg of the ladder and is cinched tightly to preclude slippage. Note FIG. 1.

The top strap 36 extends over the open upper end of the holder portion 12 to secure the drill 14 therein. The top strap 36 has a pair of female snap fasteners 38 disposed on a free end thereof for mating with a pair of male snap fasteners on the front panel 16 of the holder portion 12.

The present invention is a tool accessory to accompany hand held drills. This drill holster is designed for attachment to any A-frame type ladder, allowing the drill to be held safely and securely within convenient reach of the user. The present invention, by providing a safe and convenient holster for the user, precludes the need for going up and down the ladder. Additionally, the present invention eliminates accidents and damage to drills or flooring caused by drills falling from ladders. It would be preferably fabricated of leather or could possibly be made of webbed nylon.

With the adjustable straps secured around the ladder, the holster will remain in a parallel position toward the user, enabling the drill to be inserted and removed easily. The bottom of the holster is open, to allow the drill to be inserted with a drill bit in place. The pouch on the outside of the holster provides convenient storage for bits or apexes.

The present invention can be manufactured in either a right or left hand version to allow usage on either side of a ladder. This feature would allow two drills to be used at one time, if preferred. The present invention can be used for screw-guns as well as T-styles or standard size/shape drills. It can be used by electricians, carpenters, sheet metal workers, or by homeowners working on do-it-yourself type projects.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A drill holster attached to a ladder and adapted for attaching a drill ladder to thereby provide easy access by a user comprising, in combination:

a holder portion dimensioned for receiving a drill therein, the holder portion being defined by a front panel and a rear panel secured together along lower and side edges thereof leaving an open upper end adapted to receive a drill therein, the rear panel being comprised of at least one layer of material, the holder portion including a wide upper portion and a narrow lower portion, the wide upper portion adapted for accommodating a handle of the drill, the wide upper portion having a notch formed in only the front panel within a corner thereof, the wide upper portion having a closable snap fastener disposed below the notch for securing the front panel to the rear panel to allow for wide body drills, the narrow lower portion having an opening through the-secured lower edges of the front and rear panels adapted to accommodate a drill bit of the drill therethrough;

a plurality of pouches secured to the front panel of the holder portion;

a pair of commonly configured side straps of a common length freely secured to the rear panel of the holder portion facilitating securement to the ladder at spaced upper and lower portions of the ladder respectively, the side straps extending through slots angularly disposed with respect to a longitudinal axis of the holder portion and disposed on the rear panel, a free end of each of the side straps having D-rings disposed thereon adapted to allow for adjustable securement of the holder portion to the ladder;

a top strap extending over the open upper end of the holder portion to secure the drill therein, the top strap having a pair of female snap fasteners disposed on a free end thereof for mating with a pair of male snap fasteners on the front panel of the holder portion.

* * * * *